US007390775B2

(12) United States Patent
Rees et al.

(10) Patent No.: US 7,390,775 B2
(45) Date of Patent: Jun. 24, 2008

(54) THICKENED BLEACH COMPOSITIONS COMPRISING AN AMINE OXIDE AND ANIONIC POLYMER

(75) Inventors: Wayne M. Rees, Racine, WI (US); Susan L. Bryant, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 81 days.

(21) Appl. No.: 11/074,352

(22) Filed: Mar. 7, 2005

(65) Prior Publication Data

US 2006/0199755 A1 Sep. 7, 2006

(51) Int. Cl.
*C11D 1/75* (2006.01)
*C11D 3/395* (2006.01)
*C11D 3/37* (2006.01)

(52) U.S. Cl. ..... 510/238; 510/123; 510/124; 510/191; 510/199; 510/235; 510/379; 510/367; 510/362; 510/356; 510/237; 510/398; 510/435; 510/486; 510/503; 510/509; 510/511; 510/512

(58) Field of Classification Search ..... 510/123, 510/124, 191, 199, 235, 237, 238, 356, 362, 510/367, 379, 398, 435, 486, 503, 509, 512, 510/511
See application file for complete search history.

(56) References Cited

U.S. PATENT DOCUMENTS 4,116,849 A 9/1978 Leikhim
4,116,851 A 9/1978 Rupe et al.
4,554,091 A * 11/1985 Jones et al. ..... 252/187.25
4,839,077 A 6/1989 Cramer et al.
5,011,538 A 4/1991 Smith
5,034,150 A 7/1991 Smith
5,135,675 A 8/1992 Elliott et al.
5,510,047 A 4/1996 Gabriel et al.
5,624,891 A 4/1997 Smialowicz et al.
5,630,883 A 5/1997 Steer et al.
5,705,467 A 1/1998 Choy et al.
5,783,537 A 7/1998 Ahmed et al.
5,975,095 A 11/1999 Ahmed et al.
6,020,293 A 2/2000 Ahmed et al.
6,136,768 A 10/2000 Dawson et al.
6,479,444 B1 11/2002 Porticos et al.

FOREIGN PATENT DOCUMENTS

EP 256638 * 2/1988
EP 0256638 B1 1/1991
EP 1001010 * 2/2000
EP 1001010 B1 5/2003

* cited by examiner

*Primary Examiner*—Charles I Boyer

(57) ABSTRACT

Surfactant-thickened active chlorine-containing bleach compositions including at least one water soluble anionic styrenic polymer are described. The styrenic polymer serves to improve the rheology properties of the thickened bleach composition. The thickened bleach composition additionally includes a surfactant-based thickening system including an amine oxide, and an alkaline agent to maintain the pH of the composition at about 10 or greater. The amine oxide includes at least 75% of one or more $C_{14}$-$C_{18}$ alkyl dimethyl amine oxides. The thickened bleach compositions have reduced viscosity, decreased elastic properties, with improved flow and pour properties resulting from the inclusion of the styrenic polymer.

15 Claims, No Drawings

THICKENED BLEACH COMPOSITIONS COMPRISING AN AMINE OXIDE AND ANIONIC POLYMER

FIELD OF THE INVENTION

The present invention is directed to thickened bleach compositions having improved flow and pour properties based on the inclusion of a water-soluble anionic styrene-containing polymer to control the viscosity and Theological properties of the thickened compositions.

BACKGROUND OF THE INVENTION

It is advantagous to formulate highly thickened hypochlorite bleach solutions for cleaning hard surfaces, such as drains, countertops, sinks, bathtub enclosures, lavatories, and other common household surfaces. The efficacy of liquid hypochlorite bleach cleaning compositions is greatly improved by increasing their viscosity significantly above that of a "water-thin" fluid, especially for compositions to be applied to non-horizontal surfaces in use or to be poured through standing water (as with a drain cleaner) in use. The term "highly thickened" is to be understood herein to refer to viscous compositions having viscosities of about 500 centipoise (cps) or greater at ambient temperatures of about 20-25° C.

Consumers also react favorably to highly thickened liquid products in that these fluids often connote a "concentrated" composition in the mind of the user. A common chemical approach to creating thickened hypochlorite bleach solutions is to employ surfactant-based thickening systems, which create a long range surfactant micelle structure within the composition. However, many such surfactant-based thickening systems tend to produce fluids with undesirable flow properties as the fluids become highly viscous (greater than about 500 cps). This is especially problematic at colder temperatures (below about 20° C.), as many surfactant-based thickening systems tend to increase in viscosity as the fluid's temperature decreases. Such fluids can exhibit undesirable physical and visual flow properties in use, e.g., a rubbery/elastic/lumpy or uneven flow, making the fluids difficult to dispense from the dispenser in which they are contained or visually unpleasant when dispensed. This has been observed in particular in thickened hypochlorite bleach solutions formulated with alkyl dimethyl amine oxide surfactants in combination with various co-surfactants. Examples of viscous hypochlorite bleach compositions thickened using amine oxide surfactants in combination with various co-surfactants are disclosed in U.S. Pat. Nos. 3,684,722; 4,282,109; 5,462,689; 5,624,891; and 5,703,036. Thickened hypochlorite bleach solutions may exhibit undesirable physical and visual flow properties especially when the solutions include amine oxide surfactants containing linear C14 to C18 alkyl groups. C14-C18 alkyl dimethyl amine oxide surfactants are highly desirable for thickening hypochlorite bleach solutions as they are low cost, efficient for thickening, and exhibit good chlorine bleach stability. However, the formulation of thickened bleach compositions with such amine oxide surfactants which have good pour properties at or below ambient temperature (about 1-25° C.) is difficult to achieve because such thickening systems often give rise to elastic thickened fluids with undesirable visual/physical properties (rubbery, elastic, lumpy flow) when poured from conventional containers.

U.S. Pat. No. 5,135,675 discloses the use of sulfonated polystyrene polymers in combination with clays in chlorine bleach-containing thickened automatic dishwashing compositions. The combination of thickening clays and a sulfonated styrenic polymer enhances the low shear viscosity, long-term viscosity retention and fluid uniformity in the thickened hypochlorite bleach compositions as compared to similar compositions thickened only with clays. U.S. Pat. No. 5,510,047 discloses the use of anionic styrenic copolymers as cleaning-enhancing disperants in chlorine bleach-containing detergent compositions. EP 1 001 010 B1 and EP 0 824 147 B1 disclose the use of various anionic styrenic polymers as free radical scavangers for bleach-containing compositions, for improved cleaning and storage stability. None of these patents indicate the use of the disclosed polymers to reduce the elastic character of bleach-containing solutions, nor do the patents indicate that the polymers improve low-temperature flow properties of their compositions. In addition, the noted patents set forth examples wherein the polymer additives are used in substantial quantities, i.e., greater than 0.1% and usually about 1% or more.

U.S. Pat. No. 4,839,077 employs anionic polymers produced from various combinations of charged and uncharged co-monomers in surfactant-thickened bleach compositions to synergistically increase the viscosity of the formulations in combination with the surfactant thickeners. The '077 patent discloses various copolymers formed from a combination of hydrophobic (uncharged) and hydrophilic (anionic charged) co-monomers, the most preferred being an ethylene/acrylic acid copolymer combination. While styrenic water soluble polymers are claimed in the '077 patent, no experimental evidence is provided to substantiate their efficacy. Also, the '077 patent discloses containing about 0.1% to 1.0% polymer, such that the weight ratio of surfactant thickener to polymer is from about 5:1 to 30:1 to be effective.

SUMMARY OF THE INVENTION

The invention includes providing a thickened bleach composition having improved rheology at room temperature and below, i.e., about 25° C. or less.

The invention further includes providing a thickened bleach composition with a reduced elastic nature and improved flowability and pourability.

The invention additionally includes providing a thickened bleach composition having controlled rheological and viscosity properties due to the inclusion of a water soluble anionic styrenic polymer.

The invention involves incorporating a very small amount, i.e., less than 0.1% by weight, of one or more anionic styrene-containing water soluble polymer to a thickened bleach composition. The inclusion of the styrenic polymer improves the rheology (flow properties) of the thickened bleach compositions at temperatures of about 1° C. to 25° C. The improved rheology evidences itself in reduction of the elastic nature of the thickened bleach compositions with resulting improvements in flow and pour properties of the fluids. The anionic styrene-containing water soluble polymer(s) are also referred to herein as a water soluble anionic styrenic polymer. As used herein, the term "styrenic polymer" refers to a synthetic macromolecule comprised of a large number of repeating subunits or monomers. The anionic styrenic polymer may be composed of a single styrenic monomer (homopolymer), such as poly(sodium para-styrenesulfonate). The styrenic polymer may also be composed of two or more repeating monomers (heteropolymer), such as a maleic acid/styrene copolymer or an acrylic acid/styrene/alpha-methylstyrene terpolymer. The styrenic polymers are employed, based on solids, at less than 0.10% by weight in the thickened bleach compositions of the invention, preferably about 0.050-

0.0001% by weight, and most preferably in a range of about 0.03-0.001% by weight. Unlike prior art compositions utilizing water soluble anionic styrenic polymers to thicken hypochlorite bleach compositions, the incorporation of the water-soluble anionic styrenic polymer into surfactant-thickened bleach compositions of the invention measurably decreases the viscosity of the thickened composition. Styrenic polymers suitable for use in the composition of the invention include sulfonated polystyrene, poly(sodium styrene sulfonate), styrene-acrylate heteropolymers, and sulfonated polystyrene-maleic acid heteropolymers.

The thickened bleach compositions described herein have a controlled and improved rheology and viscosity based on the inclusion of at least one anionic styrenic polymer in a surfactant-thickened bleach formulation. In the inventive surfactant-thickened bleach compositions, the anionic styrenic polymer measurably decreases the viscosity of the composition. In addition, increasing levels of polymer have been found to produce substantially decreasing solution viscosities. Thus, in the compositions of the invention only very small amounts of polymer are utilized in the thickened bleach compositions so as not to lower the viscosity of the compositions to an undesirable level. This translates to a very high weight ratio of surfactant to polymer, for example, when the polymer is present in a range of about 0.001-0.05% by weight, the weight ratio of surfactant to polymer is from about 1500/1 to about 30/1 for a composition which is thickened with about 1.5% by weight surfactant.

The technology of the invention is applicable to thickened bleach-based cleaning compositions, such as for drains, hard surfaces and the like wherein the thickened compositions can be considered as "gel" or "crème" (opaque) bleach cleaners. The technology is desirable for compositions which are poured or squeezed from their containers by the user. The inventive technology allows for the formulation of inexpensive surfactant-thickened bleach compositions having minimal elastic character, so as to provide viscous, fluid compositions with highly desirable flow/pouring properties. The inventive technology is highly desirable for commercial thickened bleach products sold in climates where the product is likely to be stored and/or used in a "cold condition" (i.e., temperatures of about 20° C. and below). Similar "cold in-use conditions" may occur in warmer climates where the product is stored and/or used inside a cold walk-in refrigerated room or cool basement.

Without being bound by theory, it is believed that the anionic styrene-containing polymer has enough surfactant-like character (hydrophilic and hydrophobic segments) which insert into portions of the long range three-dimensional micelle array of the surfactant thickening system. The inserted polymer creates a disruption in the surfactant micelle array, thereby greatly reducing the elastic nature of the composition, and improving fluid pour properties, with only a slight to moderate reduction in the fluid viscosity. The mole ratio of employed surfactant to polymer is extremely large, thus the polymer must be inserted into only a very minor fraction of the surfactant array to have the desired effect. In fact, the inclusion of successively greater amounts of polymer increasingly lowers the viscosity. Hence it is highly desirable to employ only very minor amounts of polymer into the inventive compositions (greater than zero but less than 0.1%). In contrast, an extremely hydrophilic anionic polymer, such as sodium polyacrylate homopolymer, does not have sufficient hydrophobic character to insert into the surfactant micelle array, and thus does not have any impact on the viscosity or flow properties of the thickened bleach composition. In fact, the inclusion of a polyacrylate homopolymer into a representative thickened hypochlorite bleach formulations having undersirable (highly elastic) flow properties was evaluated. The inclusion of a sodium polyacrylate homopolymer did not reduce the elastic nature or viscosity of the representative highly elastic thickened hypochlorite bleach compositions, nor did it improve the flow properties at ambient or lower temperatures. Thus, the bleach compositions of the invention must include a homopolymer or heteropolymer with at least one styrenic monomer to effectively provide desirable flow properties to the thickened bleach compositions of the invention.

Certain other bleach-stable, water-soluble polymers having sufficient hydrophobic character have also been determined to function in a similar manner to that of the water soluble styrenic polymers of the invention. For example, copolymers of 1-alkenes and acrylic acid (e.g., a copolymer of 1-hexene and acrylic acid) and copolymers of 1-alkenes and maleic acid (e.g., a copolymer of 1-octene and maleic acid) provide decreased viscosity and elasticity similar to the styrene-containing water-soluble polymers described herein. Such polymers are not highly desirable, however, due to cost and limited commercial availability.

The rheology-enhancing properties of the water-soluble anionic styrenic polymer additives are applicable to many amine oxide-based surfactant thickening systems useful in bleach-containing compositions, in particular active chlorine-containing bleach compositions. Thickening systems which employ alkyl dimethyl amine oxide surfactants, in particular where at least 75% of the amine oxide includes a linear C14-C18 alkyl group, optionally in combination with one or more co-thickening anionic and/or zwitterionic surfactants, are preferred. Any combination of linear C14 to C18 alkyl dimethyl amine oxides may be employed. The compositions may also include minor amounts of lower chain length alkyl dimethyl amine oxides (i.e., C12 or C10 alkyl groups), however these amine oxides should not exceed about 25% of the total amine oxide surfactant content of the thickened bleach composition, as they have a significant negative effect on the viscosity of the thickened bleach compositions. Preferably, amine oxides containing a lower chain length alkyl group comprises less than about 10% of the total amine oxide content of the composition formulation.

The anionic and zwitterionic co-thickening surfactants can include C9-C14 alkyl carboxylate soaps; C6-C12 alkyl sulfate salts; C10-C14 alkyl ether sulfate salts; alkyl aryl sulfonate salts; benzoate salts; C10-C18 alkyl sarcosinate salts; C8-C18 alkyl betaine salts; mono/di-alkyl phosphate ester salts of C6-C12 alcohols; and mono/di-alkyl phosphate ester salts of C8-C12 ethoxylated alcohols. It is preferred that one or more of these anionic and/or zwitterionic co-surfactants be employed in combination with an amine oxide surfactant. The total surfactant content of the thickened bleach composition should not exceed about 6% by weight, preferably less than 4% by weight, and most preferably less than 2% by weight surfactant.

The thickened bleach compositions of the invention include an active chlorine-containing bleach component, preferably a hypochlorite salt. The chlorine bleach component is preferably present in an amount of about 0.1 to about 10% by weight total available chlorine in the composition.

Due to the presence of the active chlorine-containing bleach component, an alkaline agent should also be present to provide stability to the bleach component. Stability is provided by including the alkaline agent in an amount sufficient to maintain a pH of about 10 or greater in the composition.

The ability to control the rheology or viscosity of a thickened bleach composition is of significant benefit to both the end product user as well as the product manufacturer. The end user obtains a product which has good flow and pour properties at both room temperature and below, allowing flexibility in both use and storage since desired thickness and flow properties can be maintained under common environmental conditions. As to a manufacturing process, a more easily manufactured finished product (i.e., a thickened fluid within a container) is achieved since the anionic styrenic polymer provides for improved preparation and filling of the thickened fluid during manufacture. In a preferred sequence of preparation, the water soluble anionic styrenic polymer is added to a batch mixture prior to addition of the key thickening components(s). This enhances the stirrability of the mixture and the ease at which it can be further mixed and filled into containers, especially under cool batching conditions. The presence of the anionic styrenic polymer serves to control the degree of thickening, decreases the fluid elasticity, and enhances flowability and pourability during manufacturing, especially at temperatures of about 25° C. and below. Thus, handling of the thickened bleach composition of the invention is greatly enhanced at both the manufacturing and end-use stages of the product life cycle.

DETAILED DESCRIPTION OF PREFERRED EMBODIMENTS

The thickened bleach composition of the present invention preferably comprises (1) an active chlorine-containing bleach component; (2) a surfactant-based thickening system including an amine oxide which is at least in part, preferably, about 75% of one or more linear C14-C18 alkyl dimethyl amine oxide surfactants; (3) a water-soluble anionic styrenic polymer which is a homopolymer or heteropolymer containing at least one styrenic monomer; (4) at least one alkaline agent in an amount sufficient to provide a pH to the composition of about 10 or greater; (5) water; and optionally (6) an anionic and/or zwitterionic co-surfactant.

The active chlorine-containing bleach component preferably is a hypochlorite salt compound. The source of hypochlorite bleach may be selected from various active-chlorine compounds which provide a source of hypochlorite ion in aqueous solution. Examples of suitable compounds include (1) alkali metal hypochlorite salts, such as LiOCl, NaOCl, and KOCl; (2) alkaline earth hypochlorite salts, such as $Ca(OCl)_2$; (3) chlorinated alkali metal phosphate salts, such as chlorinated trisodium phosphate dodecahydrate; (4) chlorinated cyanuric acid and derivatives thereof, such as sodium dichloroisocyanurate; (5) chlorinated hydantoins and derivatives thereof, such as dichlorodimethylhydantoin; and (6) chlorinated arylsulfonamides and derivatives thereof, such as sodium N-chlorobenzenesulfonamide.

The preferred sources of hypochlorite bleach of the present invention are the alkali metal and alkaline earth hypochlorite salts. The most preferred source of hypochlorite bleach is sodium hypochlorite, NaOCl.

A suitable range of active chlorine-containing bleach component for use in the present invention is about 0.1% to about 10% total available chlorine by weight in the inventive compositions, more preferably, about 1.0-8.0% by weight, and most preferably about 2.0-7.0% by weight.

The thickening system of the composition contains one or more amine oxide surfactants, in particular at least about 75% of one or more alkyl dimethyl amine oxide surfactant having the formula:

$$R_2R^A N(O)$$

where $R=CH_3$ and $R^A$=linear $C_{14}$ to $C_{18}$ alkyl group.

Representative examples of amine oxides of the above formula include myristyl dimethyl amine oxide, cetyl dimethyl amine oxide, and stearyl dimethyl amine oxide. Preferably, about 10-80% of the amine oxide surfactant in the inventive compositions is comprised of cetyl or stearyl dimethyl amine oxides, as these materials are highly efficient thickening surfactants, especially in combination with co-surfactants as described below.

The inventive compositions may also include minor amounts of lower chain length alkyl dimethyl amine oxides (e.g. linear C12 or C10 alkyl groups). These amine oxides, however, should not exceed about 25% of the total amine oxide surfactant content of the thickened bleach composition, as they have a significant negative effect on the viscosity of the thickened bleach compositions. Preferably, alkyl dimethyl amine oxides having a C12 or lower alkyl group comprise less than about 10% of the total amine oxide content in the inventive compositions.

In a preferred embodiment of the present invention, the thickened bleach compositions contain a mixed surfactant system including one or more alkyl dimethyl amine oxide surfactant in combination with one or more anionic and/or zwitterionic co-surfactant. Anionic and zwitterionic co-surfactants suitable for use in the composition include (1) C9 to C14 alkyl carboxylate soaps; (2) C6 to C12 alkyl sulfates; (3) C8 to C16 alkane sulfonates; (4) C10 to C16 alkyl ether sulfates having 1-4 moles of ethoxylation; (5) C10 to C18 acyl sarcosinates; (6) neutralized salts of mono/di-phosphate esters of C6 to C12 alcohols; (7) neutralized salts of mono/di-phosphate esters of C8 to C16 ethoxylated alcohols; (8) C8 to C14 alkyl dimethyl betaines; (9) aryl sulfonates; (10) alkyl diphenyloxide sulfonates; and benzoates.

Preferred anionic co-surfactants include linear C10 and C12 alkyl carboxylate soaps; C6 to C10 alkyl sulfates; C10 to C18 acyl sarcosinates; alkyl ether sulfates having a C10 to C14 alkyl group and 2-3 moles of ethoxylation; neutralized salts of mono/di-phosphate esters of C6 to C10 alcohols; and sulfonate salts of toluene, xylene, and cumene.

Preferred inventive compositions employ one or more of these anionic and/or zwitterionic co-surfactants in combination with an amine oxide surfactant(s). The total surfactant content of the thickened bleach composition of the invention should not exceed about 6% by weight, preferably less than 4% by weight, and most preferably less than 2% by weight surfactant. The total surfactant content should preferably be at least about 0.4% by weight.

The compositions of the invention contain one or more water soluble anionic styrenic polymers.

The water soluble anionic styrenic polymer can be formed from a single type of monomer wherein the monomer provides both a styrene functional group and an anionic functional group when dissolved in water. Representative examples include the sodium salts of poly(styrene sulfonate) and poly(styrene carboxylate).

The water soluble anionic styrenic polymer can also be formed from two or more types of monomer. In this instance, at least one of the monomer types must provide an anionic functional group when dissolved in water, and at least one of the monomers must contain a styrenic functional group. Monomers containing a styrenic functional group include styrene, sulfonated styrene, vinyl benzoic acid, and styrene derivatives, such as alpha-methylstyrene and sulfonate/carboxylate derivatives thereof. Monomers suitable for providing an anionic functional group when dissolved in water include acrylic acid, methacrylic acid, maleic acid and half-esters thereof, maleic anhydride, fumaric acid, itaconic acid, sulfonated styrene (styrene sulfonic acid), vinyl benzoic acid, vinyl sulfonic acid, and vinyl phosphonic acid. When the water soluble anionic styrenic polymer is formed from two or more types of monomers, the resulting polymer must contain at least an effective amount of styrenic monomer to provide reduction in both viscosity and elasticity of the thickened bleach composition as compared to when the styrenic monomer is not present. Without being limited to theory, the effective amount of styrenic monomer present is sufficient to provide incorporation into (and disruption of) the surfactant thickening system micellar array, resulting in a reduction of the elasticity and viscosity of the thickened bleach composition. A water soluble anionic styrenic polymer formed from two or more types of monomers, therefore, preferably contains at least about a 5% mole fraction of monomer units having a styrenic group so as to be effective in accordance with the invention.

Representative examples of polymers formed from at least two types of monomers, suitable for use in the compositions described herein include copolymers of acrylic acid and styrene; copolymers of maleic anhydride and styrene; partially sulfonated poly(styrene), where the mole ratio of sulfonated to non-sulfonated styrene functional groups in the polymer is about 1/1 or greater; copolymers of acrylic acid and sulfonated styrene; copolymers of maleic anhydride and sulfonated styrene; copolymers of vinyl sulfonic acid and styrene; and terpolymers of vinyl sulfonic acid, acrylic acid, and sulfonated styrene.

Commercial examples of water soluble anionic styrenic polymers useful in the inventive compositions described herein include:

- Poly(styrene sulfonic acid), avg. MW=-70,000, Versa TL-71, Alco Chemical Corp., Chattanooga, Tenn.;
- Sodium salt of poly(styrene sulfonate), avg. MW=130,000, Versa TL-130, Alco Chemical Corp., Chattanooga, Tenn.;
- Sodium salt of styrene/acrylate copolymer, avg. MW=3,000, Alcosperse 747, Alco Chemical Corp., Chattanooga, Tenn.;
- Sodium salt of sulfonated styrene/maleic acid copolymer, avg. MW=20,000, Versa TL-4, Alco Chemical Corp., Chattanooga, Tenn.;
- Sodium salt of styrene/maleic acid copolymer, avg. MW=5,500, SMA 1000 HNa, Sartomer Company, Warrington, Pa.; and
- Sodium salt of styrene/alpha-methylstyrene/acrylate terpolymer, avg. MW=8,500, Joncryl 678, Johnson Polymer, Racine, Wis.

The styrenic polymers are employed, based on solids, at less than 0.10% by weight in the thickened bleach compositions of the invention, preferably about 0.050-0.0001% by weight, and most preferably in a range of 0.03-0.001% by weight. Surprisingly, the observed enhancements in pour properties obtained from the inventive combination of water soluble anionic styrenic polymer and thickened chlorine-containing bleach solution can be obtained using polymers having a wide range of average molecular weights. The average molecular weight of the water soluble anionic styrenic polymers effective in the inventive compositions ranges from about 2,000 to about 1,000,000.

The inventive compositions require the use of one or more alkaline agents in an amount sufficient to maintain an alkaline pH in the inventive compositions for good stability of the chlorine-containing bleach component. The pH of the inventive solutions is about 10 or greater, preferably greater than 11.0, and most preferably greater than 12.0 at 25° C. Alkaline agents suitable for inclusion in the compositions include alkali metal hydroxides, alkaline earth hydroxides, alkali metal phosphates, alkali metal silicates, alkali metal carbonates, and alkali metal borates.

For reasons of low cost and high bleach stability, the preferred alkaline agent for the inventive compositions is NaOH. The preferred amount of NaOH for use in the compositions is about 0.3% to about 10% by weight, the most preferred range being about 0.5% to 6% by weight.

Commercial grade NaOCl solutions contain a significant amount of salt, NaCl, as a byproduct of manufacture. The inclusion of salt as an electrolyte in the compositions of the invention helps produce high viscosity solutions, since the viscosity enhancing effects of the surfactant thickening system is responsive to the ionic strength of the solution. However, it may be necessary, especially if the amount of desired bleach in the inventive composition is low (e.g. about 4% NaOCl or less) to add supplemental electrolyte to the compositions to further enhance viscosity. The alkaline agents above are suitable sources of supplemental electrolyte for the compositions. Other sources of suitable electrolyte include alkali metal chlorides and sulfates, such as sodium/potassium chloride and sodium/potassium sulfate.

Optional ingredients includable in the compositions of the invention are conventional adjuvants, such as a fragrance/perfume to enhance user satisfaction when using the product. A suitable hypochlorite bleach-stable fragrance may be included, up to a level of about 0.4% by weight fragrance. Further, one or more tinting agents may be added to the compositions to impart a user-pleasing color/tint to the thickened bleach compositions. Very small amounts of bleach-stable dyes and/or pigments may be used for this purpose. Ultramarine blue (UMB) pigment and copper-chlorinated phthalocyanine pigments are commonly employed for this purpose due to their good color stability in hypochlorite bleach solutions.

An example of a preferred composition formulation according to the invention is as follows:

| Ingredients | Wt. % |
|---|---|
| Sodium Hypochlorite (Bleach; oxidizer) | 0.5-8% |
| Dimethyl $C_{14-18}$ Alkyl Amine Oxide (Surfactant; cleaning/thickening agent) | 0.5-2% |
| $C_{10-12}$ Alkyl Carboxylate (Surfactant; cleaning/thickening agent) | 0.1-1% |
| Sodium Hydroxide (Alkali agent; bleach stabilizer) | 0.5-5% |
| Sodium Silicate (Alkali agent; anticorrosion/bleach stabilizing agent) | 0-0.5% |
| Water Soluble Anionic Styrenic Polymer (Rheology modifier) | 0.001-0.03% |
| Fragrance | 0-0.15% |
| Water | Balance to 100% |

Further, examples of compositions according to the invention and comparative compositions are set forth below to show the ability of the inventive compositions to modify the rheology of thickened bleach compositions.

EXAMPLE 1

Representative Elastic Thickened Bleach Cleaner Compositions Having Undesirable Flow Properties Elastic thickened bleach cleaner Formulas 1 and 2 were prepared according to the compositional outline in Table 1.

TABLE 1

| Ingredients | Formula 1 (% by weight) | Formula 2 (% by weight) |
|---|---|---|
| Amine oxide surfactant (1) | 1.20 | 1.20 |
| Sodium hydroxide | 3.00 | 3.00 |
| Sodium silicate (2) | 0.20 | 0.20 |
| Potassium caprate | 0.40 | — |
| Sodium 2-ethylhexylsulfate (3) | — | 0.14 |
| Sodium hypochlorite | 5.0 | 5.0 |
| Deionized water | To 100% | To 100% |

(1) Supplied as Ammonyx MCO, 30% actives myristyl/cetyl dimethyl amine oxide solution, Stepan Company, Northfield, IL.

(2) Supplied as OxyChem Sodium Silicate Liquid-Grade 40, Occidental Chemical Corp., Dallas, TX.

(3) Supplied as Stepanate EHS, 40% sodium 2-ethylhexylsulfate solution, Stepan Company, Northfield, IL.

EXAMPLE 2

Thickened Bleach Cleaner Formulas 1A-G and 2A-G Containing Polymer Additive

TABLE 2

Polymers added to elastic thickened bleach compositions of Formula 1

| Formula Code | Polymer Commercial Name | Wt. % Polymer Active in Formula |
|---|---|---|
| 1A | Goodrite 7600N (A) | 0.0500 |
| 1B | Versa TL-4 (B) | 0.0250 |
| 1C | SMA1000HNa (C) | 0.0020 |
| 1D | Joncryl 678 (D) | 0.0025 |
| 1E | Versa TL-71 (E) | 0.0040 |
| 1F | Versa TL-130 (F) | 0.0040 |
| 1G | Alcosperse 747 (G) | 0.0030 |

TABLE 3

Polymers added to elastic thickened bleach compositions of Formula 2

| Formula Code | Polymer Commercial Name | Wt. % Polymer Active in Formula |
|---|---|---|
| 2A | Goodrite 7600N (A) | 0.0500 |
| 2B | Versa TL-4 (B) | 0.0200 |
| 2C | SMA1000HNa (C) | 0.0020 |
| 2D | Joncryl 678 (D) | 0.0038 |
| 2E | Versa TL-71 (E) | 0.0040 |
| 2F | Versa TL-130 (F) | 0.0040 |
| 2G | Alcosperse 747 (G) | 0.0030 |

(A) Sodium polyacrylate, avg. MW = 60,000, Noveon Inc., Cleveland, OH.
(B) Sulfonated styrene/maleic acid copolymer, avg. MW = 20,000, Alco Chemical Corp.
(C) Styrene/maleic acid copolymer, avg. MW = 5,500, Sartomer Company.
(D) Styrene/alpha-methylstyrene/acrylate copolymer, avg. MW = 8,500, Johnson Polymer.
(E) Sulfonated polystyrene, avg. MW = 70,000, Alco Chemical Corp.
(F) Sodium salt of sulfonated polystyrene, avg. MW = 130,000, Alco Chemical Corp.
(G) Styrene/acrylate copolymer, avg. MW = 3,000, Alco Chemical Corp.

EXAMPLE 3

Viscosity and Flow Properties For Compositions of Formulas 1, 1A-G, 2, 2A-G (Examples 1 & 2)

Solution viscosities were evaluated for Formulas 1, 1A-G, 2, and 2A-G at 23° C. and 12° C. Viscosities were determined using a Brookfield LVT rotational viscometer, spindle 2 or 3@12 rpm. Viscosity values are set forth in units of centipoise (cps). Flow characteristics were evaluated for Formulas 1, 1A-G, 2, and 2A-G at temperatures of 23° C. and 12° C. Flow characteristics were evaluated by pouring samples of the thickened fluids from glass containers, samples and containers being equilibrated to either 23° C. or 12° C. as indicated, and making visual observations of the flow characteristics of the thickened liquids as poured from the containers.

TABLE 4

Viscosities and flow characteristics for compositions of Formulas 1, 1A-G

| Composition | Viscosity @ 23° C. | Viscosity @ 12° C. | Flow Characteristics @ 23° C. | Flow Characteristics @ 12° C. |
|---|---|---|---|---|
| 1 | 3800 | 3900 | HR, HE, L | HR, HE, L |
| 1A | 3750 | 4150 | HR, HE, L | HR, HE, L |
| 1B | 2450 | 2450 | S, FE | S, FE |
| 1C | 1750 | 2300 | S, FE | S, FE |
| 1D | 2500 | 2550 | S, FE, SE | S, FE, SE |
| 1E | 2100 | 2250 | S, FE | S, FE |
| 1F | 2650 | 2550 | S, FE, SE | S, FE, SE |
| 1G | 2200 | 2450 | S, FE, SE | S, FE |

TABLE 5

Viscosities and flow characteristics for compositions of Formulas 2, 2A-G

| Composition | Viscosity @ 23° C. | Viscosity @ 12° C. | Flow Characteristics @ 23° C. | Flow Characteristics @ 12° C. |
|---|---|---|---|---|
| 2 | 1900 | 2850 | HR, HE, L | HR, HE, L |
| 2A | 1850 | 2800 | HR, HE, L | HR, HE, L |
| 2B | 760 | 1300 | S, FE | S, FE |
| 2C | 750 | 1300 | S, FE | S, FE |
| 2D | 1140 | 1700 | S, FE, SE, SL | S, FE, SE, SL |
| 2E | 1000 | 1500 | S, FE | S, FE |
| 2F | 1210 | 1700 | S, FE, SE | S, FE, SE |
| 2G | 1060 | 1700 | S, FE, SE | S, FE, SE |

HR = Highly rubbery, fluid flow initiates slowly when poured.
HE = Highly elastic, significant fluid recoil when flow from container is abruptly stopped.
L = Fluid appears very lumpy or clumpy when poured.
S = Smooth flow, absence of lumpy/clumpy appearance when poured.
FE = Fluid flow initiates quickly/easily when poured.
SE = Slightly elastic, very slight fluid recoil when flow from container is abruptly stopped.
SL = Fluid appears very slightly lumpy/clumpy when poured.

The visual flow characteristics of the elastic thickened bleach compositions of Formulas 1 and 2 are highly undesirable at both 23° C. and 12° C. However, the addition of very minor amounts of water soluble anionic styrenic polymers (B through G) to Formulas 1 and 2 greatly improves the flow properties of the resulting thickened bleach compositions at both 23° C. and 12° C. The addition of the polymers B through G to the Formulas 1 and 2 also decreases the viscosity of those compositions by about 30-60% at a given temperature, as expressed in units of cps. In contrast, the polyacrylate homopolymer additive (A) has no significant effect on either the viscosity or flow characteristics of the thickened bleach compositions of Formulas 1 and 2.

EXAMPLE 4

Viscosity for Thickened Bleach Compositions Having Various Levels of Water Soluble Anionic Styrenic Polymer Additive

TABLE 6

Water soluble anionic styrenic polymer added to elastic thickened bleach composition of Formula 1

| Formula Code | Polymer Commercial Name | Wt. % Polymer Active in Formula | Viscosity @ 23° C. | Viscosity @ 12° C. |
|---|---|---|---|---|
| 1 | None (see Example 1) | — | 3800 | 3900 |
| 1H | SMA1000HNa | 0.0010 | 2500 | 2400 |
| 1C | SMA1000HNa | 0.0020 | 1750 | 2300 |
| 1I | SMA1000HNa | 0.0040 | 950 | 1450 |
| 1J | Versa TL-71 | 0.0020 | 2850 | 2600 |
| 1E | Versa TL-71 | 0.0040 | 2100 | 2250 |
| 1K | Versa TL-71 | 0.0080 | 1350 | 1700 |

TABLE 7

Water soluble anionic styrenic polymer added to elastic thickened bleach composition of Formula 2

| Formula Code | Polymer Commercial Name | Wt. % Polymer Active in Formula | Viscosity @ 23° C. | Viscosity @ 12° C. |
|---|---|---|---|---|
| 2 | None (see Example 1) | — | 1900 | 2850 |
| 2L | SMA1000HNa | 0.0010 | 1050 | 1700 |
| 2C | SMA1000HNa | 0.0020 | 750 | 1300 |
| 2M | SMA1000HNa | 0.0040 | 400 | 600 |
| 2E | Versa TL-71 | 0.0040 | 1000 | 1500 |
| 2N | Versa TL-71 | 0.0060 | 750 | 1250 |
| 2O | Versa TL-71 | 0.0080 | 600 | 950 |

Thus, it can be seen from the results in Tables 6 and 7, that the inclusion of water soluble anionic styrenic polymers into the thickened bleach compositions of Formulas 1 and 2 produces a measurably decreased viscosity for the resulting compositions. Furthermore, observed reductions in viscosity directly correlate with increasing amounts of added water soluble styrenic polymer.

As will be apparent to one skilled in the art, various modifications can be made within the scope of the aforesaid description. Such modifications being within the ability of one skilled in the art form a part of the present invention and are embraced by the appended claims.

The invention claimed is:

1. A thickened bleach composition comprising (a) about 0.1 wt. % to about 10 wt. % of an active chlorine-containing bleach component;

(b) greater than 0 but less than about 6 wt. % of an amine oxide-containing surfactant thickening system comprising at least one amine oxide, wherein about 75% or greater of the amine oxide is one or more linear $C_{14}$-$C_{18}$ alkyl dimethyl amine oxide and wherein at least about 10% of the one or more linear $C_{14-18}$ alkyl dimethyl amine oxide comprises a linear $C_{16}$ alkyl dimethyl amine oxide or a linear $C_{18}$ alkyl dimethyl amine oxide;

(c) from about 0.0001 to about 0.05 wt. % of a polymer comprising a water-soluble anionic homopolymer or anionic heteropolymer containing at least one styrenic monomer, said polymer having a molecular weight of from about 2000 to about 1,000,000;

(d) an alkaline agent present in an amount sufficient to provide a pH to said composition of about 10 or greater;

(e) from about 0.1 to about 1 wt. % of a co-surfactant which is at least one member selected from the group consisting of $C_{9-14}$ alkyl carboxylate soaps, $C_{8-16}$ alkane sulfonates, $C_{10-18}$ acyl sarcosinates, neutralized salts of mono/di-phosphate esters of $C_{6-12}$ alcohols, neutralized salts of mono/di-phosphate esters of $C_{8-16}$ ethoxylated alcohols, $C_{8-18}$ alkyl betaines, aryl sulfonates, alkyl aryl sulfonates, alkyl diphenyloxide sulfonates, benzoates, and sulfonate salts of toluene or xylene or cumene; and (f) water;

wherein said polymer reduces both viscosity and fluidic elasticity of said composition providing said composition with a viscosity of at least about 500 cps at 20°-25° C. and rendering said composition pourable at a temperature of about 25° C. or less; and wherein said surfactant thickening system is present to said polymer in a wt. ratio of from about 1500/1 to about 30/1.

2. The thickened bleach composition according to claim 1, wherein said polymer is selected from the group consisting of:

(a) homopolymers of sulfonated styrene, (b) homopolymers of vinyl benzoic acid, and (c) heteropolymers formed from (i) one or more styrenic monomers selected from the group consisting of styrene, sulfonated styrene, vinyl benzoic acid, alpha-methyl styrene and sulfonate or carboxylate derivatives thereof, and (ii) one or more co-monomers providing an anionic functional group when dissolved in water selected from the group consisting of acrylic acid, methacrylic acid, maleic acid and half-esters thereof, maleic anhydride, fumaric acid, itaconic acid, sulfonated styrene, vinyl benzoic acid, vinyl sulfonic acid, and vinyl phosphonic acid.

3. A thickened bleach composition according to claim 1, wherein said anionic heteropolymer contains at least about a 5% mole fraction of said at least one styrenic monomer.

4. The thickened bleach composition according to claim 1, wherein said amine oxide and said co-surfactant in combination are present in an amount of about 6 wt. % or less but greater than 0.

5. The thickened bleach composition according to claim 1, wherein said alkaline agent is at least one member selected from the group consisting of alkali metal hydroxides, alkaline earth hydroxides, alkali metal phosphates, alkali metal silicates, alkali metal carbonates and alkali metal borates.

6. The thickened bleach composition according to claim 1, wherein said active chlorine-containing bleach component is at least one member selected from the group consisting of alkali metal hypochlorite salts, alkaline earth hypochlorite salts, chlorinated alkali metal phosphate salts, chlorinated cyanuric acid and derivatives thereof, chlorinated hydantoins and derivatives thereof, and chlorinated aryl sulfonamides and derivatives thereof.

7. The thickened bleach composition according to claim 1, wherein the composition comprises (a) from about 0.5 to about 8 wt. % of said active chlorine-containing bleach component;

(b) from about 0.5 to about 2 wt. % of said amine oxide-containing surfactant thickening system;

(c) from about 0.001 to about 0.03 wt. % of said polymer;
(d) from 0.5 to about 6 wt. % of said alkaline agent;
(e) from about 0.1 to about 1 wt. % of said co-surfactant which is a linear $C_{10}$-$C_{12}$ alkyl carboxylate; and
(f) a balance of said water.

8. A method to decrease fluidic elasticity and viscosity of a surfactant thickened hard surface cleaning composition including about 0.1 wt. % to about 10 wt. % of an active chlorine-containing component and greater than 0 but less than about 6 wt. % of an amine oxide-containing surfactant thickening system including at least about 75% of one or more linear $C_{14-C18}$ alkyl dimethyl amine oxides wherein at least about 10% of the one or more linear $C_{14-C18}$ alkyl dimethyl amine oxides comprise a linear $C_{16}$ alkyl dimethyl amine oxide or a linear $C_{18}$ alkyl dimethyl amine oxide, thereby improving flow and pour properties comprising providing a thickened fluid and adding during or subsequent to said providing of said thickened fluid from about 0.0001 to about 0.05 wt. % of a polymer comprising a water soluble anionic homopolymer or anionic heteropolymer containing at least one styrenic monomer and said polymer having a molecular weight of from about 2000 to about 1,000,000, wherein addition of said polymer to said thickened fluid decreases viscosity and elasticity of said thickened fluid to provide said composition with a viscosity of at least about 500 cps at 20°-25° C. and renders said composition pourable at a temperature of about 25° C.; and wherein said surfactant thickening system is present to said polymer in a wt. ratio of about 1500/1 to about 30/1: and wherein said composition further includes from about 0.1 to about 1 wt. % of a co-surfactant which is at least one member selected from the group consisting of $C_{9-14}$ alkyl carboxylate soaps, $C_{8-16}$ alkane sulfonates, $C_{10-18}$ acyl sarcosinates, neutralized salts of mono/di-phosphate esters of $C_{6-12}$ alcohols, neutralized salts of mono/di-phosphate esters of $C_{8-16}$ ethoxylated alcohols, $C_{8-18}$ alkyl betaines, aryl sulfonates, alkyl aryl sulfonates, alkyl diphenyloxide sulfonates, benzoates, and sulfonate salts of toluene or xylene or cumene.

9. The method of claim 8, wherein said polymer is selected from the group consisting of:

(a) homopolymers of sulfonated styrene,
(b) homopolymers of vinyl benzoic acid, and
(c) heteropolymers formed from
  (i) one or more styrenic monomers selected from the group consisting of styrene, sulfonated styrene, vinyl benzoic acid, alpha-methyl styrene and sulfonate or carboxylate derivatives thereof, and
  (ii) one or more co-monomers providing an anionic functional group when dissolved in water selected from the group consisting of acrylic acid, methacrylic acid, maleic acid and half-esters thereof, maleic anhydride, fumaric acid, itaconic acid, sulfonated styrene, vinyl benzoic acid, vinyl sulfonic acid, and vinyl phosphonic acid.

10. The method according to claim 8, wherein said anionic heteropolymer contains at least about a 5% mole fraction of said at least one styrenic monomer.

11. The method of claim 8, wherein said polymer is selected from the group consisting of homopolymers of sulfonated styrene, copolymers of acrylic acid and styrene; copolymers of maleic anhydride and styrene; partially sulfonated polystyrene; copolymers of acrylic acid and sulfonated styrene; copolymers of maleic anhydride and sulfonated styrene; copolymers of vinyl sulfonic acid and styrene; and terpolymers of vinyl sulfonic acid, acrylic acid and sulfonated styrene.

12. The method of claim 8, wherein said amine oxide and said co-surfactant in combination are present in an amount of about 6 wt. % or less but greater than 0.

13. The method of claim 8, further comprising an alkaline agent which is at least one member selected from the group consisting of alkali metal hydroxides, alkaline earth hydroxides, alkali metal phosphates, alkali metal silicates, alkali metal carbonates and alkali metal borates.

14. The thickened bleach composition according to claim 1, wherein said composition is pourable at a temperature of about 25° C. to about 1° C.

15. The method according to claim 8, wherein said composition is rendered pourable at a temperature of about 25° C. to about 1° C.

* * * * *